US009057149B1

(12) United States Patent
Vasandani et al.

(10) Patent No.: US 9,057,149 B1
(45) Date of Patent: Jun. 16, 2015

(54) EMBROIDERY AND METHOD THEREOF

(71) Applicant: GANGA INC., Hawthrone, CA (US)

(72) Inventors: Deepak Vasandani, Los Angeles, CA (US); Ryan Pepple, West Hills, CA (US)

(73) Assignee: Ganga, Inc., Hawthorne, CA (US)

( * ) Notice: Subject to any disclaimer, the term of this patent is extended or adjusted under 35 U.S.C. 154(b) by 0 days.

(21) Appl. No.: 13/975,062

(22) Filed: Aug. 23, 2013

Related U.S. Application Data

(60) Provisional application No. 61/692,471, filed on Aug. 23, 2012.

(51) Int. Cl.

| | |
|---|---|
| ***D05C 3/00*** | (2006.01) |
| ***D05C 7/00*** | (2006.01) |
| *D05C 17/00* | (2006.01) |

(52) U.S. Cl.
CPC . *D05C 17/00* (2013.01); *D05C 7/00* (2013.01)

(58) Field of Classification Search
CPC ..... D05C 17/00; D05C 3/00; D05C 17/02; D05C 17/023; D05B 1/10; D05B 11/00; D05B 19/08; D05B 61/00; D06Q 1/005
USPC ..... 112/439, 475.17–475.22
See application file for complete search history.

(56) References Cited

U.S. PATENT DOCUMENTS

| | | | | | |
|---|---|---|---|---|---|
| 1,067,605 | A | * | 7/1913 | Gretschel | 28/164 |
| 1,517,867 | A | * | 12/1924 | Sexton | 428/195.1 |
| 1,608,430 | A | * | 11/1926 | Rosenberg | 112/475.18 |
| 3,040,332 | A | * | 6/1962 | Kleinwald | 112/439 |
| 3,771,479 | A | * | 11/1973 | Mavis | 112/475.22 |
| 5,635,001 | A | * | 6/1997 | Mahn, Jr. | 156/93 |
| 6,101,962 | A | * | 8/2000 | Hinshaw | 112/475.22 |
| 6,158,055 | A | * | 12/2000 | Park | 2/195.1 |

* cited by examiner

*Primary Examiner* — Ismael Izaguirre
(74) *Attorney, Agent, or Firm* — Milord A. Keshishian

(57) ABSTRACT

The present invention discloses an embroidery that includes a backing layer, an element situated at a desired position, and coupled with the backing layer to form an integrated layer, with the integrated layer positioned on a main layer and embroidered.

5 Claims, 4 Drawing Sheets

EMBROIDERY AND METHOD THEREOF

CROSS-REFERENCE TO RELATED APPLICATIONS

This application claims the benefit of U.S. Provisional Utility Patent Application 61/692,471, filed Aug. 23, 2012, the entire disclosure of which is expressly incorporated by reference.

Where a definition or use of a term in the incorporated patent application is inconsistent or contrary to the definition of that term provided herein, the definition of that term provided herein applies and the definition of that term in the incorporated patent applications does not apply.

BACKGROUND OF THE INVENTION

1. Field of the Invention

The present invention relates to embroidery and, more particularly, to improved embroidery and a method thereof that is applicable to fabrics of articles comprised of loosely knitted material.

2. Description of Related Art

Conventional embroidery is well known and has been in use for a number of years. Embroidery may be defined as a decorative design that is formed by stitching threads or yarn directly onto a fabric. In general, conventional embroidery methods include embroidering a design on desired pre-cut pieces of a fabric from which an article of clothing is to be made. That is, a desired fabric is first generally cut to various pieces that constitute the whole of the article of clothing, and then embroidery is applied to a desired individual fabric piece. For example, the fabric may be cut to pieces that form the sleeves of a shirt, the back piece thereof, the front piece, and so on, which when sewn together form the shirt. Before sewing the fabric pieces, embroidery is directly applied to the desired fabric piece of the article of clothing in accordance with a predetermined design, and thereafter, all the pieces are sewn together to form the clothing.

Regrettably, conventional embroidery methods suffer from major disadvantages when applied to fabric comprised of loosely knitted material, a non-limiting example of which may include fabric of a T-shirt that is comprised of loosely knitted cotton. Most conventional fabrics for garments such as shirts are comprised of very loosely knitted material, such as cotton, for comfort of the wearer (with added spandex or latex fibers for improved elasticity). However, the loosely knitted material (with the added elasticity) of the fabric also allows the fabric to easily stretch (or shrink when washed). During embroidery, the embroidered areas of the fabric piece tend to "gather" due to the loose nature (ease of elasticity or stretching) of the fabric versus the number and stitch tightness of the threads that constitute the embroidery. In addition, when washed, the shrinkage of the fabric tends to wrinkle or warp the surround fabric of the embroidery (and sometimes the actually embroidery itself).

Another drawback with the conventional embroidery is that they feel very coarse or abrasive on the skin. This is particularly problematic when the article of clothing is a T-shirt where in general, they are worn without any undershirts. The conventional embroidery on the T-shirt worn by an individual directly contacts the skin of the wearer, with the embroidered threads extending from inside the T-shirt, making wearing the embroidered T-shirt very uncomfortable due to irritation of the skin caused by the coarse or abrasive feel of the embroidery threads against the skin.

A further drawback with conventional embroidery is the amount of time, material, and labor intensiveness used to embroider an article. In general, most conventional embroidery methods use a very large number of stitching threads, which consume a larger volume of material (of threads or yarn), including the time to actually complete a typical embroidered design.

Accordingly, in light of the current state of the art and the drawbacks to current embroidering methodologies mentioned above, a need exists for an improved embroidery and a method thereof that would be applicable on most fabrics, including fabric comprised of loosely knitted material, that would substantially maintain its graphic design regardless of variations in properties or characteristics of the underlying material, that would not feel abrasive or coarse against skin, and that would be more efficient and cost effective to make in terms of time, labor, and material used.

BRIEF SUMMARY OF THE INVENTION

A non-limiting, exemplary aspect of an embodiment of the present invention provides an embroidery, comprising:

a backing layer;

an element coupled with the backing layer to form an integrated layer;

the integrated layer is positioned on a main layer and embroidered.

Another non-limiting, exemplary aspect of an embodiment of the present invention provides a method of embroidery, comprising:

providing an element;

patterning the element in a desired design;

placing the patterned element over a backing fabric;

securing the patterned element over the backing fabric, forming an integrated piece;

placing the integrated piece, with a top surface of the patterned element facing an inner side of the pre-cut piece so that a resulting embossment of the patterned element at an outer side of the pre-cut piece is the desired design;

securing the integrated piece onto the inner side of the pre-cut piece.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

DETAILED DESCRIPTION OF THE INVENTION

Figure 1A:
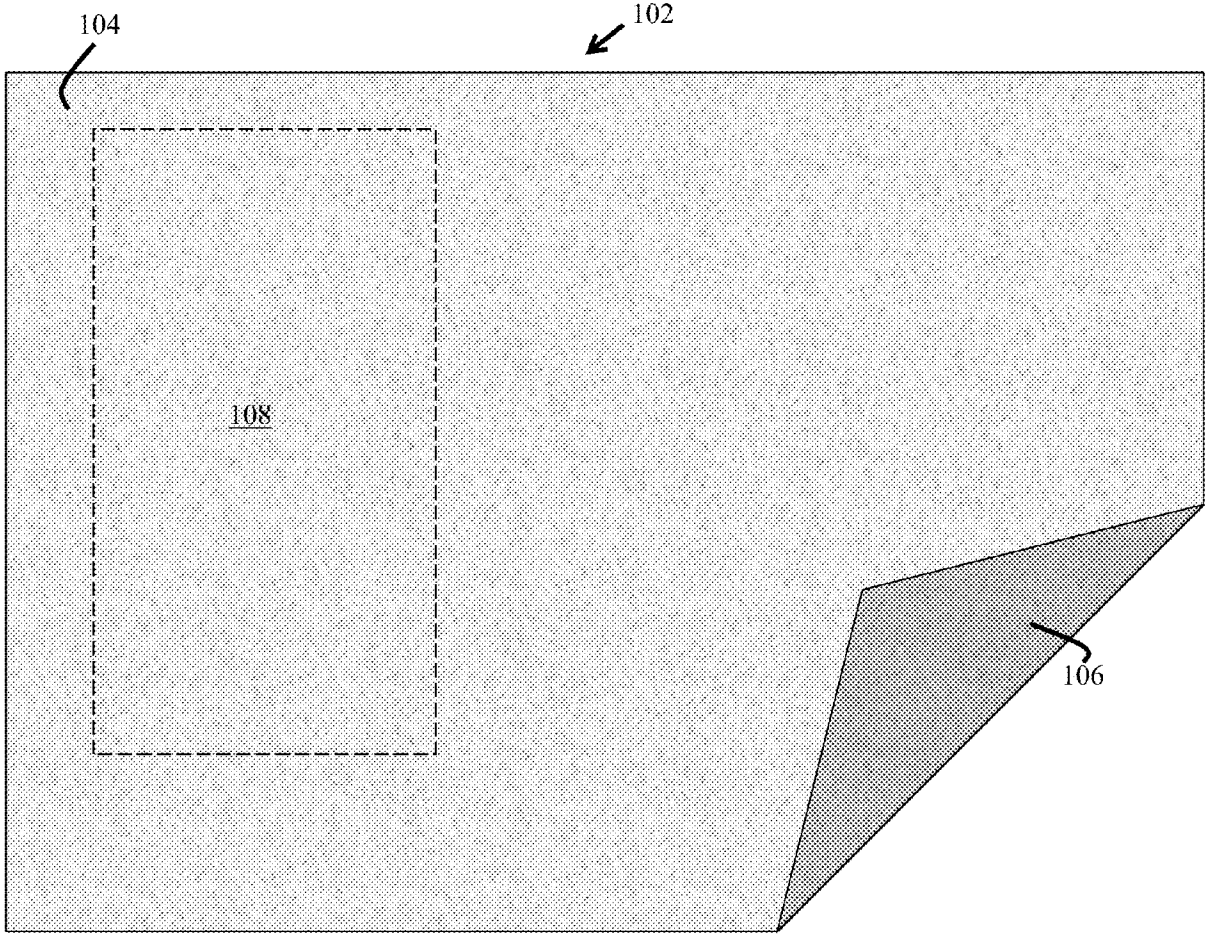
FIG. 1A is a non-limiting, exemplary illustration of a pre-cut piece of a fabric selected for embroidery in accordance with one or more embodiments of the present invention.

The detailed description set forth below in connection with the appended drawings is intended as a description of presently preferred embodiments of the invention and is not intended to represent the only forms in which the present invention may be constructed and or utilized.

One or more embodiments of the present invention provides improved embroidery and a method thereof that is applicable on most fabrics, including fabric comprised of loosely knitted material. The improved embroidery and a method thereof in accordance with one or more embodiments of the present invention enable the resulting embroidery to substantially maintain its graphic design regardless of variations in properties or characteristics (shrinkage, stretching, etc.) of the underlying material. The improved embroidery and a method thereof in accordance with the one or more embodiments of the present invention does not feel abrasive or coarse against skin, and is efficient and cost effective to make in terms of time, labor, and material used.

The combinations of FIGS. 1A to 1D cumulatively illustrate non-limiting, exemplary process and components for embroidery in accordance with one or more embodiments of the present invention. In general (as shown in FIGS. 1A to 1D and further detailed below), the present invention provides embroidery that is comprised of a backing layer 112, an element 110 coupled with the backing layer 112 to form an integrated layer 120, and with the integrated layer 120 positioned at a desired location 108 on a main layer 102, with all layers (including the element 110) embroidered together.

FIG. 1A is a non-limiting, exemplary illustration of a pre-cut piece of a fabric selected for embroidery in accordance with one or more embodiments of the present invention. As illustrated, the present invention enables embroidering a design on desired pre-cut pieces 102 of a fabric (e.g., a loosely knitted fabric) from which an article is to be made. That is, as indicated above, a desired fabric is first generally cut to various pieces that constitute the whole of the article of clothing. Accordingly, the pre-cut-piece 102 may be a sleeve of a shirt, the back piece thereof, the front piece, and so on, which has been selected for application of embroidery. Before sewing the fabric pieces 102, embroidery is applied to the desired fabric piece of the article in accordance with a predetermined design, and thereafter, all the pieces are sewn together to form the article of clothing. As illustrated, the pre-cut piece 102 is comprised of an outer side 104, an inner side (reverse side) 106, and includes a predetermined desired position 108 of the embroidery, with the pre-cut piece 102 forming a main layer.

Figure 1C:
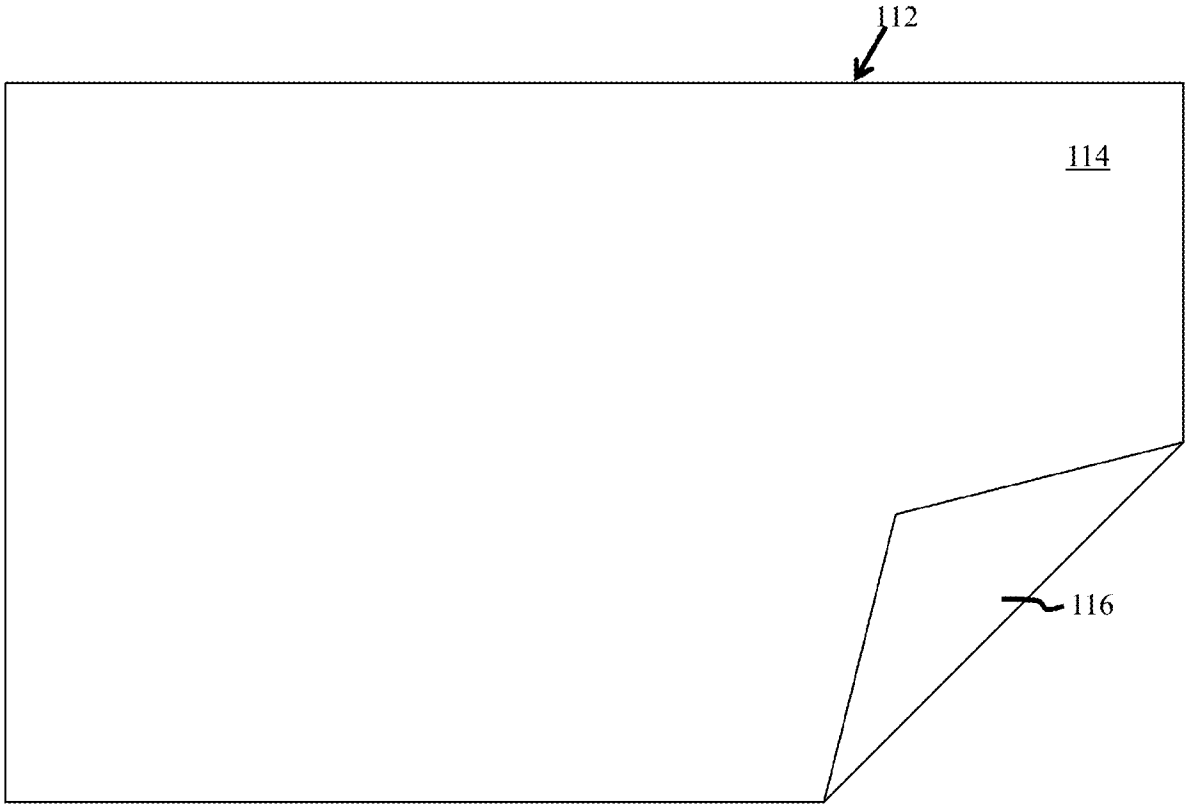
FIG. 1C is a non-limiting, exemplary illustration of a backing fabric in accordance with one or more embodiment of the present invention.
Figure 1B:
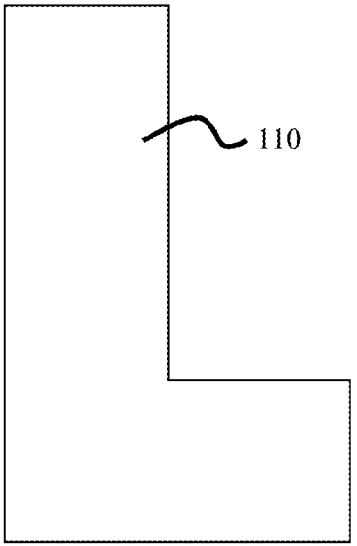
FIG. 1B is a non-limiting, exemplary illustration of an element patterned in a desired design in accordance with one or more embodiment of the present invention.

FIG. 1B is a non-limiting, exemplary illustration of an element patterned 110 in a desired design in accordance with one or more embodiment of the present invention. In this non-limiting, exemplary instance the element is patterned in the form of the capital letter "L." Accordingly, the element 110 is a pre-configured design. Non-limiting, non-exhaustive listing of examples of the element 110 in accordance with one or more embodiments of the present invention may include sponge, foam, silicon, wax, various types of plastics, or any other material that substantially maintains its shape (and preferably soft to touch). In general, the element 110 of the present invention is pre-configured to any desired shape (by any conventional manner).

FIG. 1C is a non-limiting, exemplary illustration of a backing fabric in accordance with one or more embodiment of the present invention. As illustrated, the present invention further uses a backing fabric 112 to secure the element 110 in a fixed desired position. That is, the backing fabric 112 forming the backing layer of the embroidery in accordance with the present invention is a platform that securely maintains the element 110 in the desired position. The backing fabric layer 112 further provides an added comfort when it is abutted against the skin, and may comprise of any material and configuration. A non-limiting example of a backing layer 112 may be thought of as a mere patch that includes a first side 114 and a second side 116.

Figure 1D:
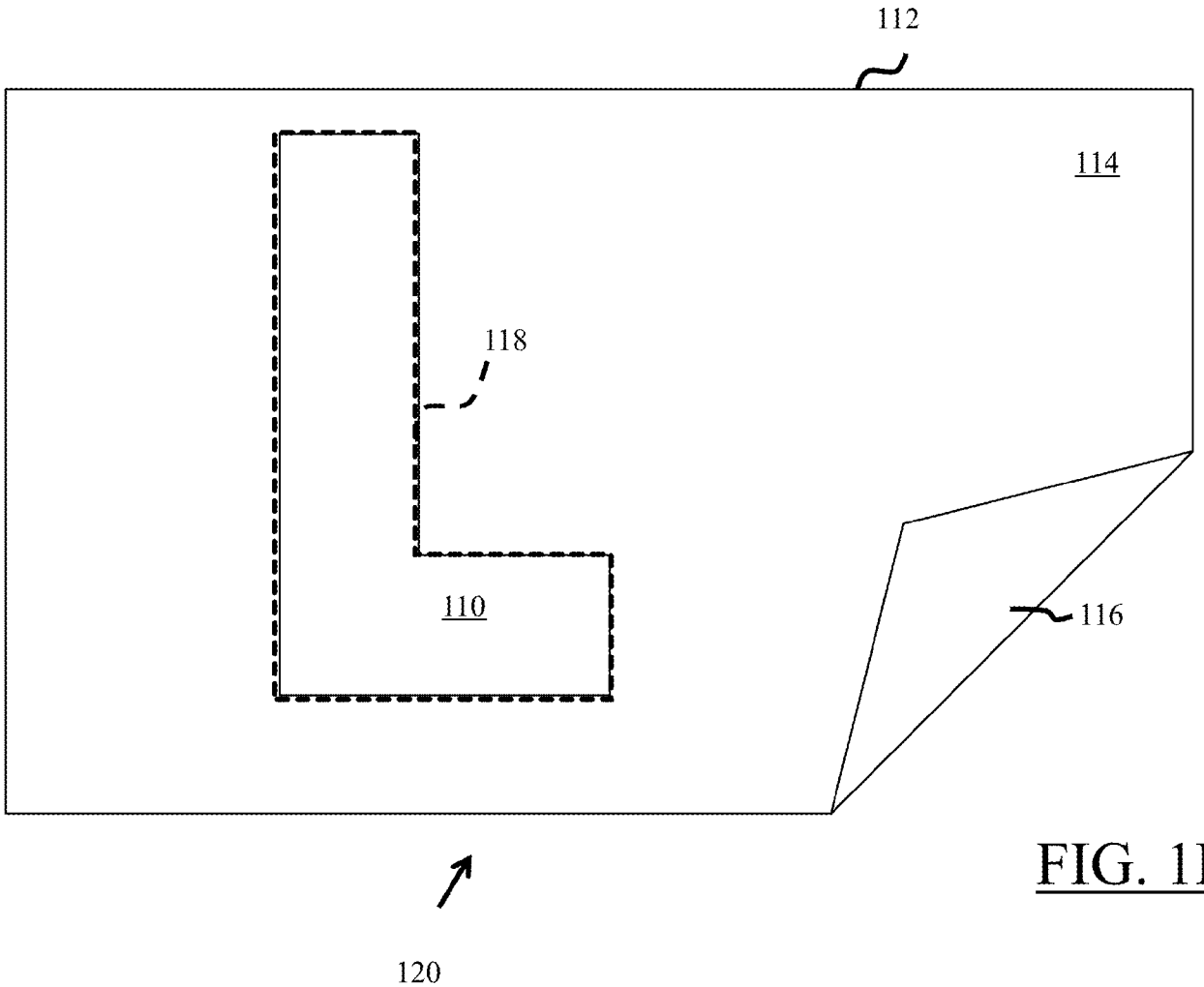
FIG. 1D is a non-limiting, exemplary illustration of an integrated piece that includes the backing fabric illustrated in FIG. 1C and the patterned element illustrated in FIG. 1B in accordance with one or more embodiments of the present invention.
Figure 2A:
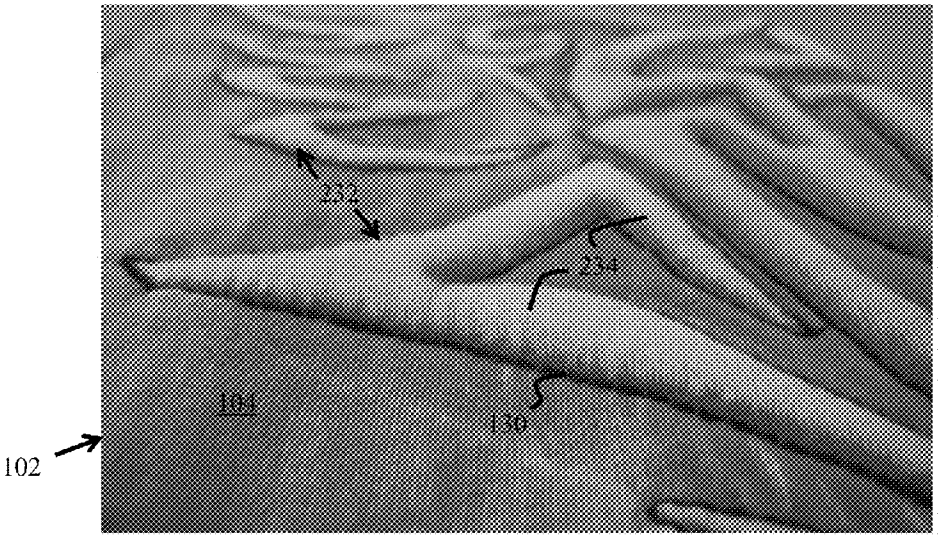
FIGS. 2A and 2B are non-limiting, exemplary illustrations of other embroidered pre-cut fabric pieces and a method thereof in accordance with one or more embodiments of the present invention.
Figure 2B:
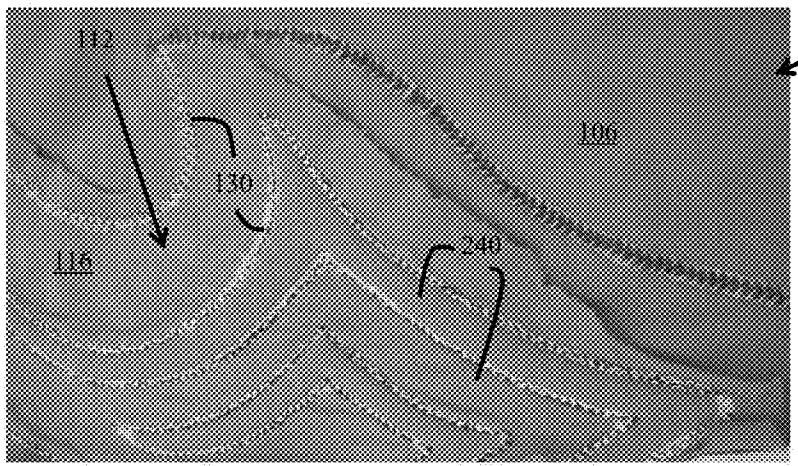

FIG. 1D is a non-limiting, exemplary illustration of an integrated piece that includes the backing fabric layer illustrated in FIG. 1C and the patterned element illustrated in FIG. 1B in accordance with one or more embodiments of the present invention. As best illustrated in FIG. 1D, the embroidery and a method thereof in accordance with one or more embodiments of the present invention include placing the patterned element 110 over the backing fabric layer 112, and securing the patterned element 110 over the backing fabric layer 112 to form an integrated piece 120. As illustrated, the element 110 is situated at a desired position and coupled with the backing fabric layer 112 to form the integrated layer 120. In general, the patterned element 110 is secured to the backing fabric 112 by a water-soluble adhesive or optionally, by sewing 118 using an embroidery machine.

As illustrated and detailed below in relation to FIGS. 2A to 2D, the element 110 of the integrated layer 120 is positioned and faces the inside surface (inner or reverse side) 106 of the main layer (or pre-cut piece) 102, which when peripherally embroidered 130, creates a raised, bulging outside (outer side) surface 104 of the main layer (or the pre-cut piece) 102. That is, the integrated piece 120 is positioned on the pre-cut piece 102, with a top surface of the patterned element 110 facing an inner side 106 of the pre-cut piece 102 (positioned within the selected area 108) so that a resulting embossment of the patterned element 110 at an outer side 104 of the pre-cut piece 102 is the desired design. The main layer 102 is fabric that is a pre-cut piece to a shape of a body of an article, forming a body fabric piece. For example, the fabric piece may be one of the sleeves, the back piece, the front piece, and so on before they are sown together. In general, all the layers (including the element 110) are embroidered together using a topstitch embroidery 130. That is, the integrated piece 120 is secured onto the inner side 106 of the pre-cut piece 102 using topstitch embroidery 130. In other words, the integrated piece 102 is embroidered onto the inner side 106 of the pre-cut piece 102 with topstitch 130 to the outer side 104 of the pre-cut piece 102. The embroidery of the integrated piece 120 to the inner side 106 of the pre-cut piece 102 causes the patterned element 110 to bulge out of the outer side 104 of the pre-cut piece 102 in the desired design from outer side 104 of the pre-cut piece 102. In general, this final embroidery is stitched 130 around the periphery of the patterned element 110, which saves time, material and labor. The bulging pattern of the element 110 may further be accentuated by further manipulation of the pre-cut piece 102 (best shown in FIG. 2A).

FIGS. 2A to 2D are non-limiting, exemplary illustrations of other embroidered pre-cut fabric pieces and a method thereof in accordance with one or more embodiments of the present invention. As illustrated in the FIGS. 2A to 2D, elements 110 (e.g., pieces of foam 110 shown in FIG. 2D) are cut to a specified shape and sewn down to a backing layer (patch) 112 of fabric (preferably using an embroidery machine). Thereafter, the integrated layer 120 (foam 110 and patch 112 combination) is positioned against the reverse (inside) 106 of the main layer (the garment) 102, with the element (or foam) 110 side of the integrated layer 120 facing the reverse (inside) side 106 of the garment 102. The integrated layer 120 is then embroidered with topstitch 130 to the garment 102. This causes the foam (element 110) to create a raised surface 232 in the shape of the graphic, which is seen on the face (outside) 104 of the garment 102. In the particular instances shown in FIGS. 2A to 2D, the fabric is washed on the face side 104 of the garment 102 to create a more visible effect 234 with the form graphic.

It should be noted that a non-limiting, exemplary use of the element 110 (after embroidered with the main layer 102) is for its mass to push through the outside 104 of the article (main layer 102) so to create a raised surface 232 thereon, providing an embossing effect with an embossed design. The actual embroidery is done from the outside surface 104 of the main layer (body fabric piece) 102. That is, the topstitch embroidery 130 is done on the outside periphery of the bulging surface 232 of the main layer 102 (around the element 110). Since the embroidery is minimal (the bulging surface 232 takes the place of the areas that would conventionally be embroidered), there is not much of a gathering, and when the article is washed or stretched, the element 110 maintains its shape. It should be noted that the top 234 of the embossments (raised sections 232) may further be manipulated (e.g., washed), which changes the color or appearance of the raised area 232 of the outer side 104 of the main layer 102 to further accentuate those portions from the rest of the surface 104 of the article 102.

Since the element 110 is generally comprised of a comfortable, cushiony material such as a foam or a sponge and the backing layer 112 may comprise of the same exact material as that of the main layer 102 (FIGS. 2B and 2C), as a further benefit, when embroidered, the element 110 also pushes through the back layer (or patch) 112 (creating a bulging effect 240) that is abutted against the skin, which provides an added cushiony feeling against the body rather than the abrasive or coarse feel of conventional embroidery. Further, the element 110 bulging 240 through the backing layer 112 causes the threads 130 of the embroidery to remain below the level of the raised bulging 240 of the surface of the backing layer 112, and away from the skin for added comfort.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, instead of using an element to create the embossment effect, a less preferred method would be embroidery done on the backing layer, then that backing layer is embroidered on the interior or inside surface of the body fabric piece with the embroidery on the backing layer protruded (bulged out) of the main layer. In other words, the embroidery on the backing layer takes the place of the element 110. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A method of embroidery, comprising:
providing an element;
patterning the element in a desired design;
placing the patterned element over a backing fabric;
securing the patterned element over the backing fabric by a water soluble adhesive, forming an integrated piece;
placing the integrated piece, with a top surface of the patterned element facing an inner side of the pre-cut piece so that a resulting embossment of the patterned element at an outer side of the pre-cut piece is the desired design;
securing the integrated piece is the desired design;

2. The method of embroidery as set forth in claim 1, where:
the integrated piece is embroidered onto the inner side of the pre-cut piece with a topstitch to the outer side of the pre-cut piece.

3. The method of embroidery as set forth in claim 1, where:
the embroidery of the integrated piece to the inner side of the pre-cut piece causes the patterned element to bulge out of the pre-cut piece in the desired design from the outer side of the pre-cut piece.

4. The method of embroidery as set forth in claim 3, where:
the embroidery is stitched around the periphery of the patterned element.

5. The method of embroidery as set forth in claim 3, where:
the bulging pattern is further accentuated by applying a fabric wash.

* * * * *